US007517104B1

(12) United States Patent
Leen

(10) Patent No.: US 7,517,104 B1
(45) Date of Patent: Apr. 14, 2009

(54) MOGUL BASED BENCH WORKLIGHT

(76) Inventor: Monte A. Leen, 11730 NE. 12th St., Bellevue, WA (US) 98005

( * ) Notice: Subject to any disclaimer, the term of this patent is extended or adjusted under 35 U.S.C. 154(b) by 50 days.

(21) Appl. No.: 11/198,973

(22) Filed: Aug. 8, 2005

(51) Int. Cl.
*F21V 21/008* (2006.01)
*F21S 8/06* (2006.01)

(52) U.S. Cl. ..... 362/33; 362/260; 362/404; 362/376

(58) Field of Classification Search ..... 362/33, 362/216, 147, 260, 404, 376, 225, 391, 407
See application file for complete search history.

(56) References Cited

U.S. PATENT DOCUMENTS

| | | | | |
|---|---|---|---|---|
| D130,745 | S | 12/1941 | Mausshardt | |
| 4,025,780 | A | 5/1977 | Krase et al. | 240/51.11 |
| 4,161,767 | A | 7/1979 | Benasutti et al. | 362/33 |
| 4,254,449 | A | 3/1981 | Benasutti et al. | 362/33 |
| 4,363,083 | A | 12/1982 | Tanaka et al. | 362/216 |
| 4,383,289 | A | 5/1983 | Lewin | 362/33 |
| 4,450,510 | A | 5/1984 | Nilssen | 362/221 |
| 4,454,569 | A | 6/1984 | Maguire | 362/127 |
| 4,477,863 | A | 10/1984 | Walz | 362/84 |
| D296,010 | S | 5/1988 | Wan | D26/42 |
| 5,199,783 | A | 4/1993 | Pelton | 362/260 |
| 5,289,357 | A * | 2/1994 | Fabbri | 362/223 |
| 5,377,086 | A * | 12/1994 | Tickner | 362/235 |
| D365,885 | S | 1/1996 | Sangen et al. | D26/3 |
| 5,811,937 | A | 9/1998 | Jiang | 315/56 |
| 5,934,787 | A * | 8/1999 | Sharma | 362/147 |
| D426,325 | S | 6/2000 | Ho | D26/3 |
| D449,400 | S | 10/2001 | Tillman et al. | D26/76 |
| 6,428,183 | B1 | 8/2002 | McAlpin | 362/225 |
| 6,814,462 | B1 * | 11/2004 | Fiene | 362/133 |
| 6,860,618 | B2 * | 3/2005 | Shemitz et al. | 362/225 |
| 7,264,379 | B2 * | 9/2007 | Ruben | 362/294 |
| 2003/0112630 | A1 * | 6/2003 | Strelnieks | 362/407 |
| 2003/0137835 | A1 * | 7/2003 | Mier-Langner et al. | 362/220 |
| 2004/0218393 | A1 * | 11/2004 | Brondt et al. | 362/391 |
| 2006/0018111 | A1 * | 1/2006 | Legat et al. | 362/147 |

* cited by examiner

*Primary Examiner*—Stephen F. Husar
*Assistant Examiner*—Peggy A. Neils
(74) *Attorney, Agent, or Firm*—Dean A. Craine

(57) ABSTRACT

A low energy, bright bench worklight that uses two threaded mogul based fluorescent bulbs at each end. The worklight includes an elongated main housing with a downward extending opening formed therein. Located inside the housing and behind each bulb is a concave reflector. Located on each end of the main housing is a light assembly that includes a longitudinally aligned socket and a PCB. Located centrally and extending transversely over the housing is a switch bracket to which a manual switch is attached to selectively control activation of the bulbs. A removable cage attached at the opening of the main housing to protect the bulbs.

9 Claims, 6 Drawing Sheets

MOGUL BASED BENCH WORKLIGHT

BACKGROUND OF THE INVENTION

1. Field of the Invention

The present invention pertains to lighting, and more particularly to fluorescent bench worklights.

2. Description of the Related Art

Fluorescent bulb-type lamps that include a threaded connector that screw into a complimentary-shaped threaded connector are relatively common. Such lamps, called mogul based lamps, have an advantage over standard incandescent bulbs because they are more energy efficient.

Heretofore, fluorescent bench lights use two to four 25 to 40 watt fluorescent tubes. The ends of the tubes connect to the slot connectors located near the opposite ends of the light's housing. Depending on the number of tubes used in the fixture, one or more electrical ballasts may be used that provides sufficiently high starting currents to initially illuminate the bulbs.

The main drawback with standard fluorescent tubes is that they are insufficiently bright for illuminating a workbench. Another drawback with such tubes is that when one of the tubes or ballasts break or malfunction, the entire light no longer operates.

What is needed is a workbench light fixture that uses low energy fluorescent light with greater brightness that does not stop operating when one of the lights breaks or malfunctions.

SUMMARY OF THE INVENTION

It is an object of the present invention to provide workbench light fixture.

It is another object of the present invention to provide a workbench fixture that uses low energy fluorescent lights.

It is another object of the present invention to provide such a workbench fixture that provides greater brightness and will continue to illuminate if one or more fluorescent lights break or malfunction.

These and other objects are met by an elongated workbench light fixture that includes an elongated main housing with two mogul-based fluorescent bulbs connected to light assemblies located at opposite ends of the main housing. The main housing is a three-sided enclosure with a downward extending opening through which light from the two mogul-based fluorescent bulbs is emitted downward onto a workbench. Located inside the main housing and behind the two bulbs are two concave reflectors designed to reflect light downward through the opening. Each light assembly is a flush mounted inside the housing and contains the associated electrical components used to operate the bulb. Located centrally in the main housing is a transversely aligned switch bracket to which a manual switch is attached and controls activation of the two bulbs. Disposed over the bracket is an inverted U-shaped reflective cover. Disposed over the downward opening on the main housing is a removable cage.

DESCRIPTION OF THE PREFERRED EMBODIMENT(S)

Figure 1:
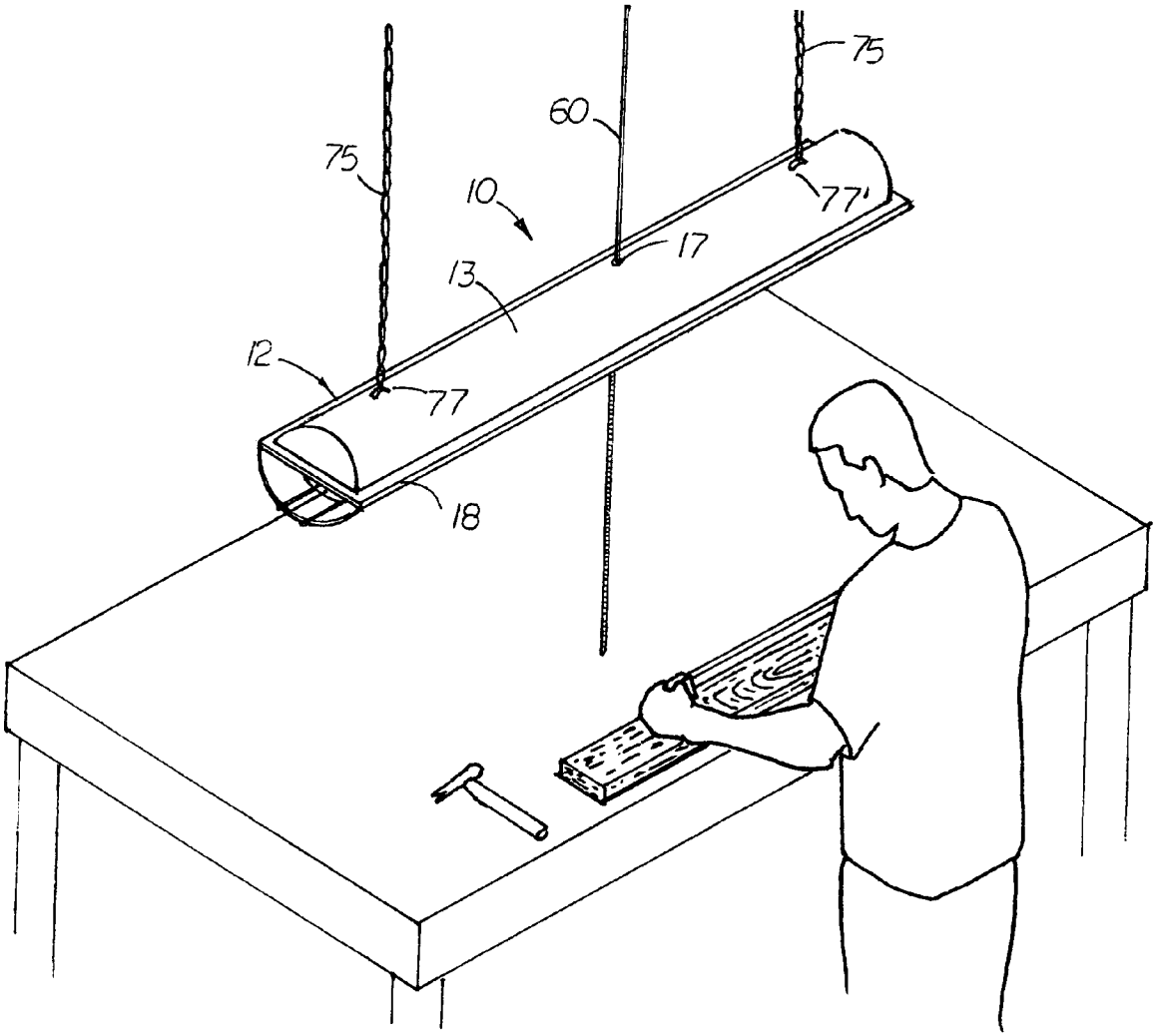
FIG. 1 is a perspective view of the mogul based bench worklight disclosed herein located over a workbench.
Figure 2:
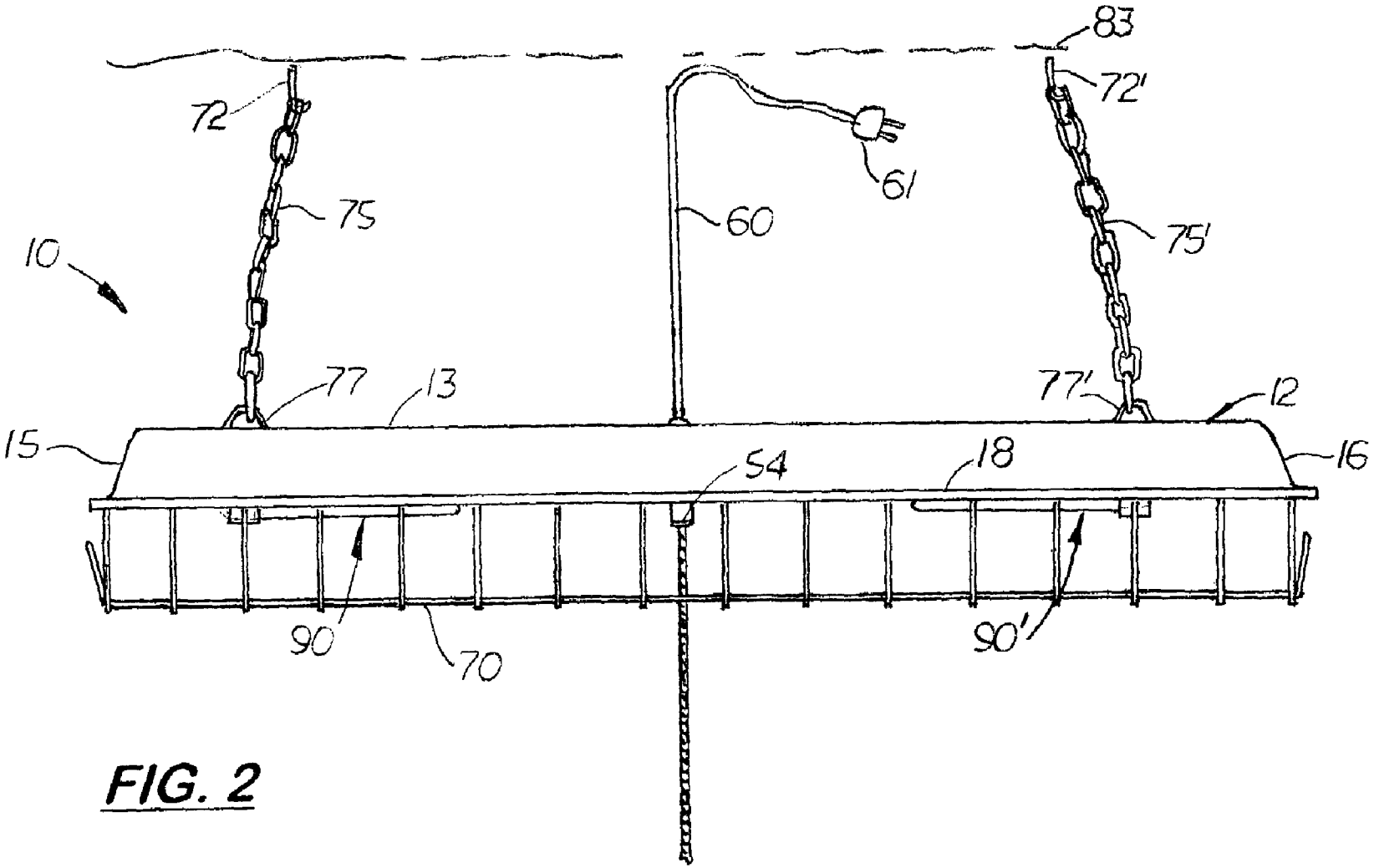
FIG. 2 is a side elevational view of the mogul based bench worklight.
Figure 3:
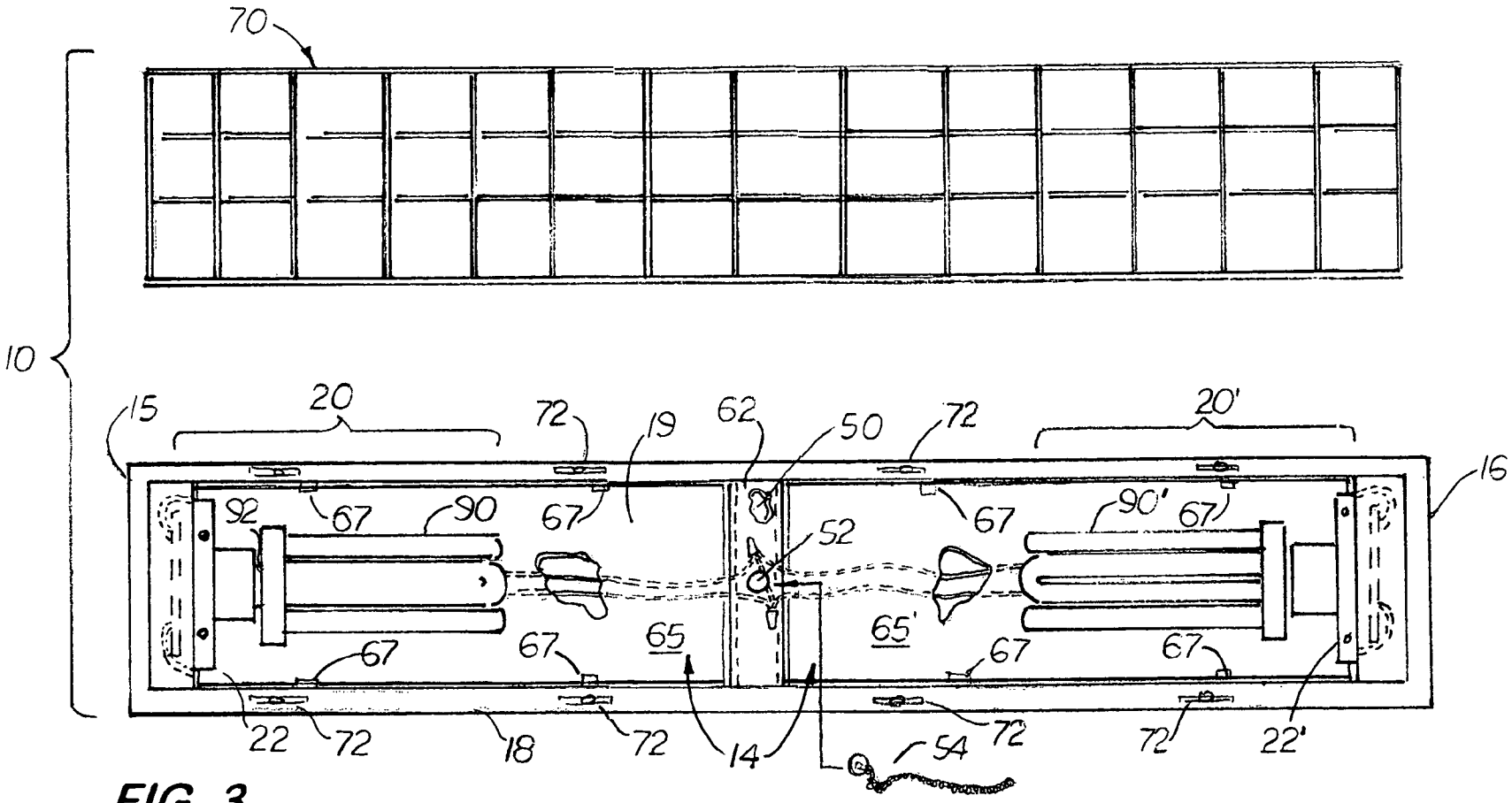
FIG. 3 is a bottom plan view of the worklight with the cage removed from the main housing.
Figure 4:
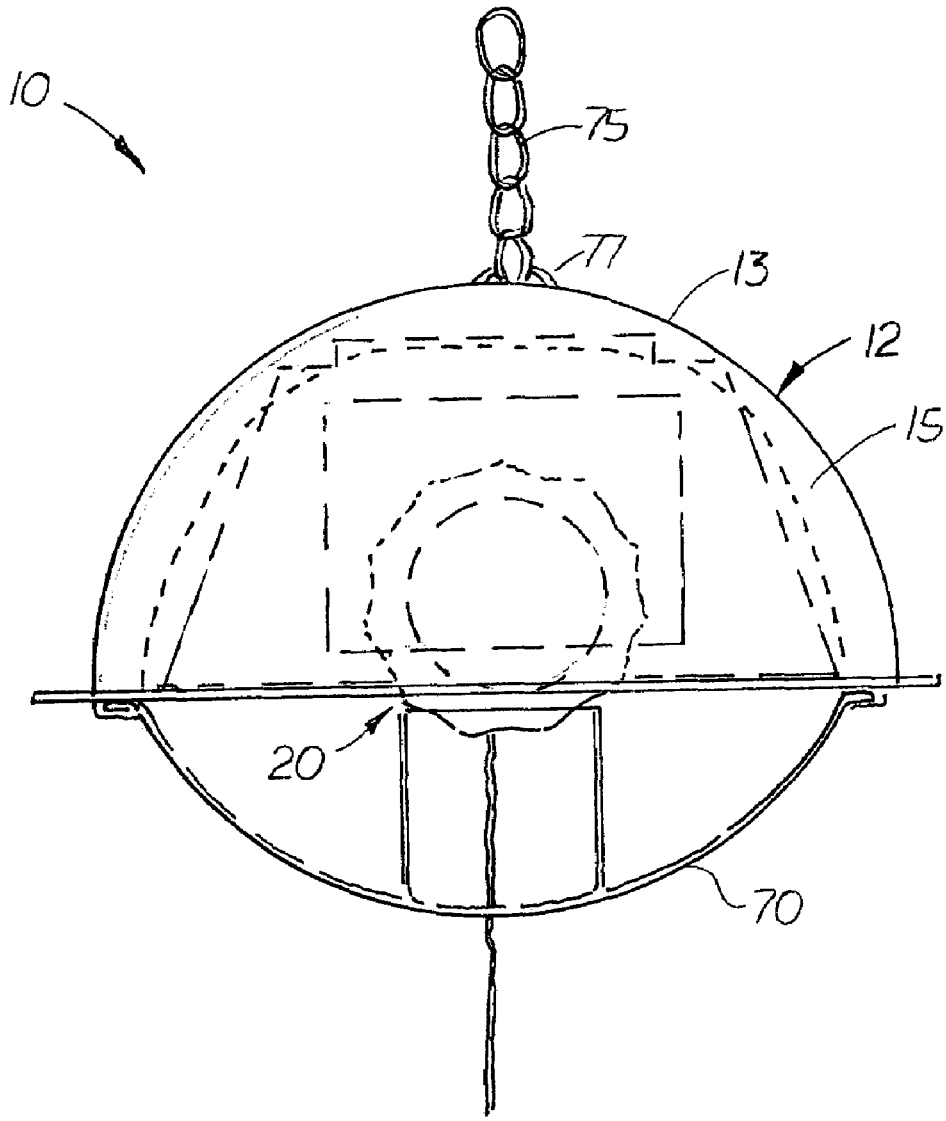
FIG. 4 is a side elevational view of the worklight.
Figure 5:
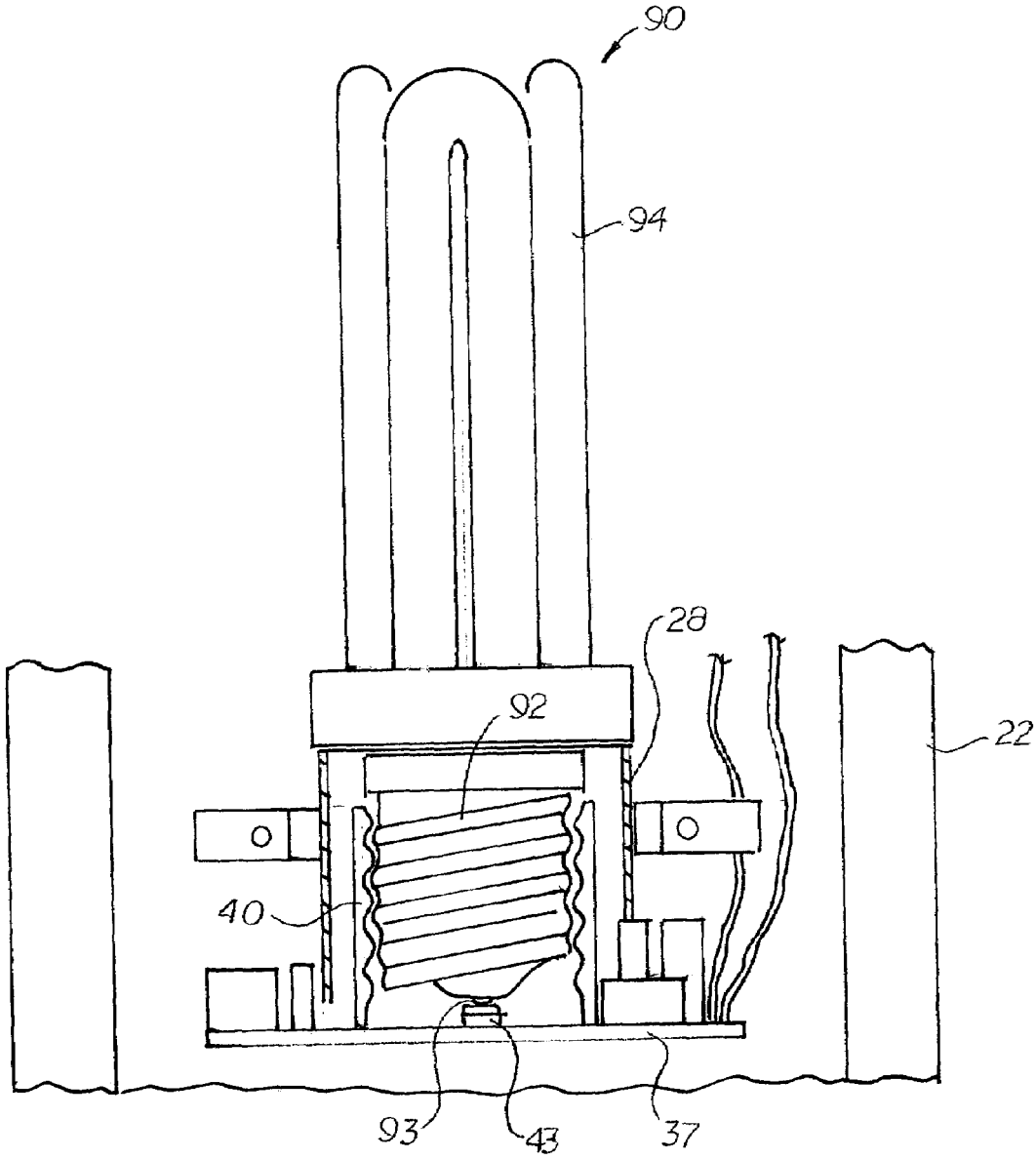
FIG. 5 is a sectional side elevational view of an assembly housing with a mogul bulb attached thereto.
Figure 6:
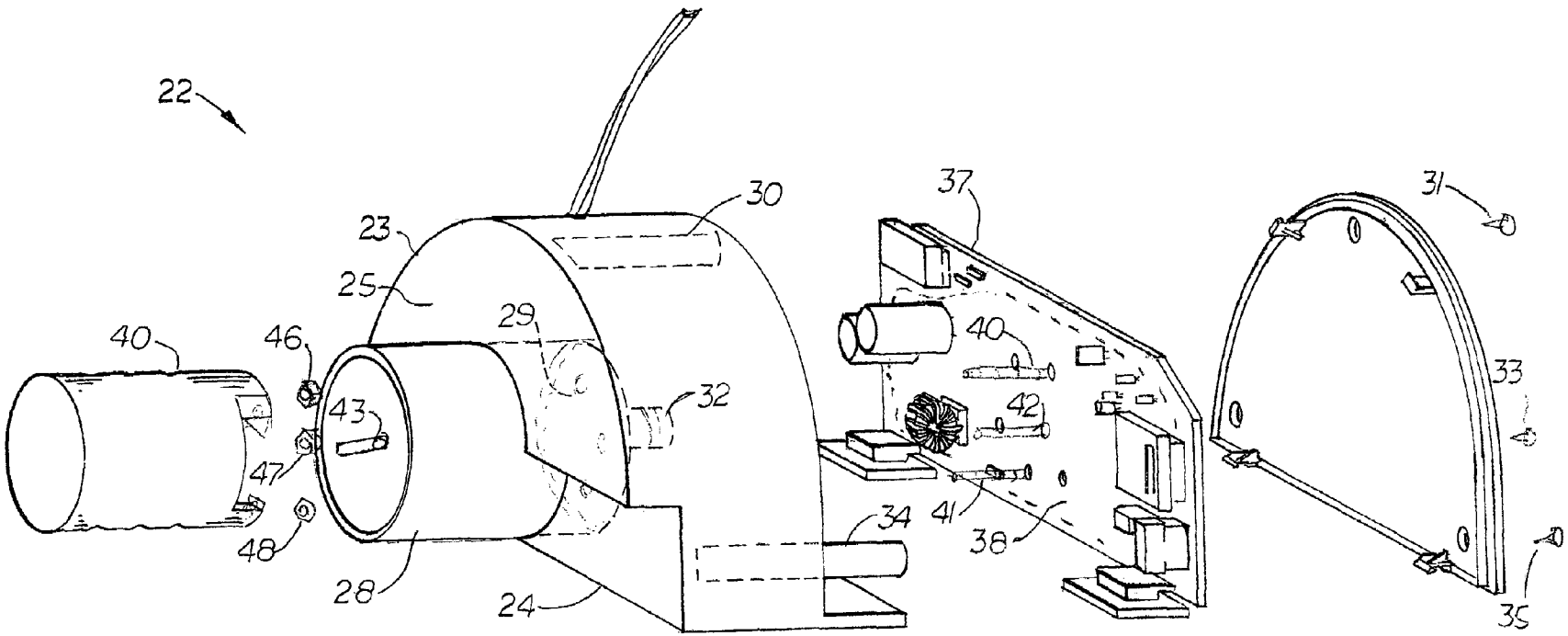
FIG. 6 is an exploded, sectional view of the assembly housing shown in FIG. 4.

There is shown in FIGS. 1-6 a mogul based bench worklight, generally referenced as 10, with two longitudinally aligned, inward directional, mogul-based fluorescent bulbs 90, 90' located on its opposite ends. The worklight 10 includes an elongated main housing 12 with an downward extending opening 14 formed therein which enables light from the two bulbs 90, 90' to be emitted downward onto a workbench located below. In the preferred embodiment, the main housing 12 includes a curved outer top surface 13 with two flat end surfaces 15, 16. Formed around the opening 14 is a continuous flange surface 18.

Formed inside the main housing 12 is an elongated cavity 19. Located inside the cavity 19 and attached on opposite end surfaces 15, 16 of the main housing 12 are two mogul bulb assemblies 20, 20', respectively. Each mogul bulb assembly 20, 20' includes an assembly housing 22, 22' that includes a semi-circular inside edge 23 and a flat, inner surface 24. The assembly housing 22, 22' is sufficient in size so that its transverse outside edge 24B is flush and even with the flange surface 18. Each assembly housing 22, 22' also includes an inward transverse surface 25 with a cylindrical-shaped socket receiver 28 formed thereon. Formed inside the assembly housing 22 are three radially spaced-apart, longitudinally aligned threaded posts 30, 32, 34. During assembly, screws 31, 33, 35 extended through the end surfaces 15, 16 of the main housing 12 and attach to the posts 30, 32, 34, respectively, to securely hold the assembly housing 22 on the adjacent end surfaces 15 or 16.

Located inside each assembly housing 22 is a transversely aligned, printed circuit board 37 (PCB) that controls the flow of electricity to the socket 40 attached inside the socket receiver 28 that receives the threads 92 on a mogul-style fluorescent bulb 90. The PCB 37 includes a ballast circuit 38 that operates the bulb 90. Permanently attached to the PCB 37 are two perpendicularly aligned threaded screws 40, 41 that extend inward and through the inside surface 29 of a socket receiver 28. Also attached to the PCB 37 is a hole for a third threaded screw 42 that attaches to a center contact bar 43 that extends centrally inside the socket 40 and makes contact with the center contact 93 on the bulb 90 when connected to the socket 40. Three nuts are attached to the screws 40, 41, 42 to connect the PCB 37 to the socket receiver 28 and to hold the contact bar 43 in a fixed position inside the socket 40.

Attached to the main housing 12 is a transversely aligned switch bracket 50 with a hole 52 formed therein, designed to receive a pull switch 54. The pull switch 54 is connected to a hot wire that extends from the end of a main electrical cord 60 that extends through a hole 17 formed on the top surface 13 of the main housing 12. Accompanying the hot wire is a ground wire that connects directly the to bracket 50. Also accompanying the hot and neutral wires in the cord 60 is a neutral wire that is spliced with two secondary wires that connect to the two light assemblies 20, 20'. Two additional secondary wires extend from connectors on the pull switch 54 to connectors on the light assemblies 20, 20'. An inverted, u-shaped cap 62 is placed over the switch bracket 50 to prevent access and exposure to the wires and the pull switch 54.

Located longitudinally behind each bulb 90 is a concave reflector 65, 65'. A plurality of tabs 67 are formed along the inside edge of the opening 14 in which the perimeter edge of the two reflectors 65, 65' engage to hold the reflector 65, 65' inside the main housing 12.

Disposed over the opening 14 in the main housing 12 is a removable cage 70. Clips 72 are attached to the flange surface 18 which holds the outer edge of the cage 70 in place over the opening 14.

During use, two hang chains 75, 75' are hung from a suitable pair of hooks 72, 72' attached to the ceiling 83. The distal ends of the two chains 75, 75' are attached to a second pair of hooks 77, 77' attached to the top surface 13 of the main housing 12.

The cage 70 is temporarily removed from the main housing 12 so that two mogul-style fluorescent bulbs 90, 90' may be attached to the two light assemblies 20, 20'. Once the bulbs 90, 90' are attached to the assemblies 20, 20' the cage 70 is then re-attached to the main housing 12 via the clips 72. The plug 61 on the electric cord 60 is then connected to an electric outlet (not shown). The pull switch 54 is then turned to the "ON" position to activate the two bulbs 90, 90'.

In the preferred embodiment, the main housing 12 measures approximately 37 inches in length, 8 inches in width, and 3½ in height or depth. Each mogul-style bulb 90, 90' is rated at 65 w with a threaded neck 92 that measures approximately 1½ inches in diameter. The glass portion 94 of each bulb 90, 90' is approximately 6½ inches in length and 2¼ inches in diameter.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A mogul based fluorescent bench worklight, comprising:

a. an elongated main housing with a downward extending opening formed therein;

b two mogul based fluorescent bulb assemblies located on opposite ends of said main housing, each said assembly including an inward directed, longitudinally aligned mogul base socket;

c. a mogul based fluorescent bulb connected to each said mogul base socket on said assemblies;

d. a reflector located inside said main housing and behind each said bulbs;

e. a switch means connected to each said bulb assembly for activating and deactivating each said bulb assembly;

f. an electric power cord connected to each said bulb assembly;

g. means for suspending said main housing from a ceiling and over a workbench;

h. a cage disposed over said opening on said main housing; and, i. means for selectively attaching said cage to said main housing.

2. The bench worklight, as recited in claim 1, wherein said means for suspending said main housing from a ceiling are two chains evenly spaced apart and attached to said main housing.

3. The bench worklight, as recited in claim 2, wherein said switch means is connected to a transversely aligned switch bracket located on said main housing.

4. The bench worklight, as recited in claim 3, further including an inverted U-shaped cover disposed over said switch bracket.

5. The bench worklight, as recited in claim 4, wherein each said main housing includes a curved top surface, two flat end surfaces, a downward extending opening formed on said main housing, and a flange surface surrounding said opening.

6. The bench worklight, as recited in claim 5, wherein each said bulb assembly includes an assembly housing mounted on opposite ends of said main housing, each said assembly housing including a socket receiver in which said socket is disposed and a traverse outer edge that is flush with said flange surface formed on said main housing.

7. The bench worklight, as recited in claim 6, wherein said means for selectively attaching said cage to said main housing are a plurality of adjustable clips attached to said flange surface.

8. The bench worklight, as recited in claim 6, wherein said reflector comprises two concave reflectors located inside said main housing and behind said bulb assemblies.

9. A mogul based fluorescent bench worklight, consisting:

a. an elongated main housing with a longitudinal axis and a downward extending opening formed therein;

b. two mogul based fluorescent bulb assemblies located on opposite ends of said main housing, each said assembly including an inward directed mogul base socket aligned with said longitudinal axis, each said base socket being connected to a PCB with a ballast circuit that operates a mogul base fluorescent bulb connected to said socket;

c. a mogul based fluorescent bulb connected to each said mogul base socket on said assemblies;

d. a reflector located inside said main housing and behind each said bulbs;

e. a switch means connected to each said bulb assembly for activating and deactivating each said bulb assembly;

f. an electric power cord connected to each said bulb assembly;

g. means for suspending said main housing from a ceiling and over a workbench;

h. a cage disposed over said opening on said main housing; and, i. means for selectively attaching said cage to said main housing.

* * * * *